US005718212A

United States Patent [19]

Allshouse et al.

[11] Patent Number: 5,718,212

[45] Date of Patent: Feb. 17, 1998

[54] COMPOSITE BOW LIMB

[75] Inventors: James R. Allshouse, Newburgh, Ind.; Christopher Peter Petrole, Evanston, Ill.; Christopher Karl DeLap; Howard Alvin Lindsay, both of Phoenix, Ariz.; Scott David Cokeing, Mesa,, Ariz.

[73] Assignee: Indian Industries, Evansville, Ind.

[21] Appl. No.: 537,973

[22] Filed: Oct. 2, 1995

[51] Int. Cl.[6] ..... F41B 5/00

[52] U.S. Cl. ..... 124/25.6; 124/23.1; 124/86

[58] Field of Search ..... 124/23.1, 25.6, 124/86, 88

[56] References Cited

U.S. PATENT DOCUMENTS

| | | | |
|---|---|---|---|
| 2,815,015 | 12/1957 | De Giacomo . | |
| 2,894,503 | 7/1959 | Pierson et al. | 124/23.1 |
| 2,945,488 | 7/1960 | Cravotta et al. | 124/23.1 |
| 3,657,040 | 4/1972 | Shobert . | |
| 3,850,156 | 11/1974 | Eicholtz | 124/23.1 |
| 4,018,205 | 4/1977 | Meyer . | |
| 4,515,142 | 5/1985 | Nurney . | |
| 4,519,374 | 5/1985 | Miller . | |
| 4,591,155 | 5/1986 | Adachi . | |
| 4,712,533 | 12/1987 | Cruise . | |
| 4,735,667 | 4/1988 | Johnston | 124/23.1 X |
| 4,747,898 | 5/1988 | Woltron | 156/153 |
| 4,894,108 | 1/1990 | Richard et al. | 156/245 |
| 5,141,689 | 8/1992 | Simonds | 124/23.1 |
| 5,312,579 | 5/1994 | Druyun et al. | 264/258 |
| 5,317,828 | 6/1994 | Yasui | 43/18.5 |
| 5,318,742 | 6/1994 | You | 264/516 |

FOREIGN PATENT DOCUMENTS

| | | | |
|---|---|---|---|
| 716040 | 9/1954 | United Kingdom | 124/23.1 |

OTHER PUBLICATIONS

Brochure for Infinity SR-500 and SR-1000 bows from Precision Shooting Equipment (Undated).

*Primary Examiner*—John A. Ricci

*Attorney, Agent, or Firm*—Woodard, Emhardt, Naughton, Moriarty & McNett

[57] ABSTRACT

An optimized composite bow limb is provided wherein the bow limb is composed mainly of thin sheets of resin impregnated laminates. In a method for making the composite bow limb, laminates are selectively distributed throughout the limb so as to aid in equalizing the stress throughout the working area of the limb and so as to increase the stiffness in the fork section of the limb. The laminates are layed up as part of a bundle in a mold such that some portions of the bundle have more fabric weaves than other portions of the bundle, and thus have increased thickness. The desired thickness of the limb is defined such that the fork portion has an increased thickness to provide increased stiffness for the tines. Additionally, the working area of the limb is designed so as to distribute stress substantially equally throughout that area such that the thinnest area of the limb is adjacent the fork section and whereas the thickness of the limb increases substantially proportional to the square of the distance from the axle hole near the tip of the limb. Heat and pressure are applied to the mold to cure the bundle. The resulting paddle is machined to form an optimized bow limb. In one embodiment of the present invention the laminates include fabric weaves including longitudinal fibers and off-axial fibers interwoven therewith.

26 Claims, 15 Drawing Sheets

| OPTIMIZED HEIGHT | | | | | | | | | | | | | | | | | | | |
|---|---|---|---|---|---|---|---|---|---|---|---|---|---|---|---|---|---|---|---|
| FLEX # = | 323 | | | | | | | | | | | | | | | | | | |
| PLY THICK | 0.0112 | | | | | | | | | | | | | | | | | | |
| MODULUS | 6250000 | | | | | | | | | | | | | | | | | | |
| | | | | | | | | | | | | | | | | | | | |
| linear station | 0 | .625 | 1 | 2 | 3 | 4 | 5 | 6 | 7 | 8 | 9 | 10 | 11 | 12 | 13 | 14 | 15 | 16 | 17 |
| # PLY | 49 | 49 | 43 | 40 | 37 | 36 | 28 | 26 | 26 | 26 | 28 | 30 | 33 | 36 | 38 | 38 | 38 | 38 | 38 |
| WIDTH | 1.178 | 1.178 | 1.178 | 1.178 | 1.178 | 1.178 | 1.86 | 1.86 | 1.86 | 1.86 | 1.86 | 1.86 | 1.78 | 1.67 | 1.62 | 1.62 | 1.62 | 1.62 | 1.62 |
| THK/PLY | .5488 | .5488 | .4816 | .4480 | .4144 | .4032 | .3136 | .2912 | .2912 | .2912 | .3136 | .3360 | .3696 | .4032 | .4256 | .4256 | .4256 | .4256 | .4256 |
| DELETE PLY | 0 | | | | | | | | | | | | | | | | | | |
| THK/PLY | .5488 | .5488 | .4816 | .4480 | .4144 | .4032 | .3136 | .2912 | .2912 | .2912 | .3136 | .3360 | .3696 | .4032 | .4256 | .4256 | .4256 | .4256 | .4256 |
| RESTN BLEED | 0.004 | | | | | | | | | | | | | | | | | | |
| FINAL HT | .5448 | .5448 | .4776 | .4440 | .4104 | .3992 | .3096 | .2872 | .2872 | .2872 | .3096 | .3320 | .3656 | .3992 | .4216 | .4216 | .4216 | .4216 | .4216 |
| | | | | | | | | | | | | | | | | | | | |
| I | 0.0159 | 0.0159 | 0.0107 | 0.0086 | 0.0068 | 0.0062 | 0.0046 | 0.0037 | 0.0037 | 0.0037 | 0.0046 | 0.0057 | 0.0072 | 0.0089 | 0.0101 | 0.0101 | 0.0101 | 0.0101 | 0.0101 |
| MOMENT | 0 | 0 | -121 | -444 | -767 | -1090 | -1413 | -1736 | -2059 | -2382 | -2705 | -3028 | -3351 | -3674 | -3997 | -4320 | -2160 | -1080 | 0 |
| M/E1 | 0.000 | 0.000 | 0.002 | 0.008 | -0.018 | -0.028 | -0.049 | -0.076 | -0.090 | -0.104 | -0.094 | -0.085 | -0.074 | -0.066 | -0.063 | -0.068 | -0.034 | -0.017 | 0.000 |
| THETA | | 0.791 | 0.791 | 0.786 | 0.772 | 0.749 | 0.711 | 0.648 | 0.566 | 0.469 | 0.370 | 0.280 | 0.201 | 0.130 | 0.066 | 0.000 | -0.051 | -0.077 | -0.086 |
| DEFLECT | | -6.4407 | -6.1441 | -5.3560 | -4.5770 | -3.8160 | -3.0859 | -2.4062 | -1.7990 | -1.2816 | -0.8621 | -0.5369 | -0.2964 | -0.1308 | -0.0328 | 0.0000 | -0.0258 | -0.0900 | -0.1712 |
| STRESS | 0 | 0 | 2727 | 11578 | 23424 | 35191 | 48172 | 68843 | 81651 | 94458 | 92214 | 89689 | 85435 | 83664 | 84078 | 90872 | 45436 | 22718 | 0 |
| K AXLE | | -50.15 | | | | | | | | | | | | | | | | | |
| | | | | | | | | | | | | | | | | | | | |
| | | | PREDICT FLEX= -322.84 | | | | NOTE: SET INPUT FLEX EQUAL TO PREDICT FLEX | | | | | | | | MAX STRESS | | 0 | | |
| | | | | | | | | | | | | | | | | | | | |

*Fig. 6*

COMPOSITE BOW LIMB

BACKGROUND OF THE INVENTION

1. Field of the Invention

The present invention relates generally to the field of composite bow limbs, and more particularly to an improved composite bow limb wherein the limb is optimized so as to distribute stress substantially evenly over a majority of the limb and to generally increase the life of the limb.

2. Description of the Prior Art

Prior art composite bow limbs have generally been of three types: (1) machine contoured limbs; (2) laminated limbs; and constant volume molded compression limbs. Machine contoured limbs use unidirectional material which have superior strength and stiffness in one direction. This use of composite material can be classified as anisotropic (exhibiting properties with different values when measured along axes in different direction in a manner inconsistent with performance goals). This anisotropic material has insufficient strength and stiffness in non-flexure directions and causes problems such as wheel lean, fork splitting and axle hole shearing. Machine contoured limbs also have a diminished ability to carry columnar compressive loads as machining the contour shifts the load off of the high strength fiber and onto the relatively low strength matrix.

Laminated limbs eliminate the problem of shifting the compressive load to the matrix as incurred in the machined contour limbs by having a skin of full length fiber glued to the core. However, this process produces a non-homogeneous limb plagued with micro cracks and glue line voids. These faults are initiation points for cracks and eventual failure. Laminated limbs are also plagued by additional problems of mating incompatible materials with various strain rates, matrix systems and glass transition temperatures. Also, laminated limbs have a degree of residual stress built into the part when at rest. This compromise occurs because the core is forced and held to a curved shape in the limb's rest position. Finally, the laminated limb has predominately unidirectional fiber orientation which has minimal torque resistance and minimal longitudinal crack arresting capability.

Constant volume molded limbs eliminate some of the problems associated with machined contour limbs and laminated limbs. These molded limbs do not suffer from the problems associated with fibers terminating on the outer skin. Also, these limbs have no residual stress at rest, nor do they suffer from mating incompatible materials. However, constant volume molded limbs do have some very important limitations. A molded limb is anisotropic and has high strength and stiffness in one direction and reduced properties in all other directions. A molded limb is also prone to fiber wash-out which haphazardly changes the orientation of the fibers. This inconsistent fiber orientation may cause resin-rich areas and poor fiber alignment. Lastly, a constant volume mold process restricts the design options of the limb limiting the designer from reducing/adding material where necessary to optimize performance.

There is a need for an optimized composite bow limb not subject to the above limitations inherent in known types of limbs.

SUMMARY OF THE INVENTION

One embodiment of the present invention involves an improved optimized composite bow limb. The composite bow limb of the present invention comprises a working area portion having a proximal end and a distal end and a fork section having s proximal end and a distal end. The proximal end of the fork section is located adjacent the distal end of the working area portion of the limb. The composite bow limb of the present invention is composed of fiber layers encased in a homogeneous resin. In one embodiment of the present invention, woven sheets of a fiber and resin material are used. In a first embodiment the woven sheets include longitudinal fibers located along a longitudinal axis through the length of said bow limb and off-axial fibers oriented at a non-zero angle from said longitudinal fibers. The longitudinal fibers are interwoven with said off-axial fibers. In another embodiment of the present invention, sheets of resin impregnated fibers, including sheets comprising longitudinal fibers, are laid up in a compression mold such that a first portion of the working area of the limb includes more sheets than a second area of the working area portion of the limb.

Additionally, the present invention involves a method for making an improved optimized bow limb.

Other objects and benefits of the present invention can be discerned from the following written description and accompanying drawings.

BRIEF DESCRIPTION OF THE DRAWINGS

FIG. 6 is a table showing the characteristics of the composite bow limb made in accordance with the specific example of FIG. 5.

DESCRIPTION OF THE PREFERRED EMBODIMENTS

Figure 1:
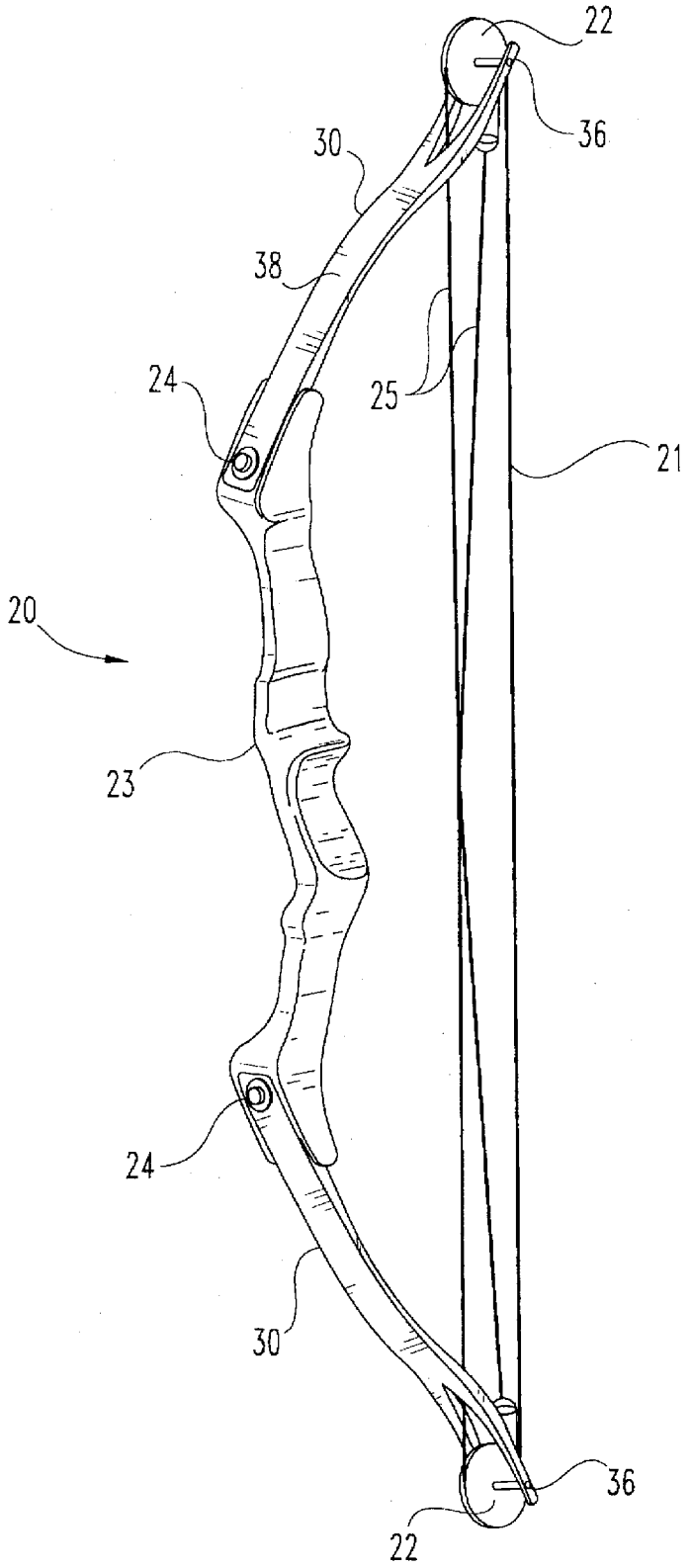
FIG. 1 is a perspective view of a compound archery bow incorporating the composite bow limbs of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1 there is shown a compound archery bow 20 which incorporates the composite bow limbs 30 of the present invention. A compound bow 20 stores energy when the string 21 is drawn. The wheels 22 rotate causing the string 21 and bus cables 25 to follow a predetermined track. This track defines the varying mechanical advantage that the string 21 imparts on the bus cables 25 and consequently, on the limbs 30.

The limbs 30 are forced to deflect, storing the energy necessary to propel an arrow (not shown). The deflection of the limbs 30 is controlled by the wheels 22. Assuming that the wheel design is fixed, the limb must maintain a given stiffness in order to store the desired amount of energy. Achieving this given stiffness is one goal when designing the composite bow limb. Further, a bow limb may be optimized by maintaining the given stiffness while optimizing the stress across the bow limb.

As shown in FIG. 1, the bow limbs 30 are attached to the handle 23 via key screws 24. Further, wheels 22 are attached to the limb 30 via axles through the axle holes 36. A single axle hole 36 extends through both tines of the fork section of each limb 30. Alternatively, a secondary axle mount system such as an overlay or a build up of material to support the wheels 22 may be used instead of drilled axle hole 36.

Figure 2:
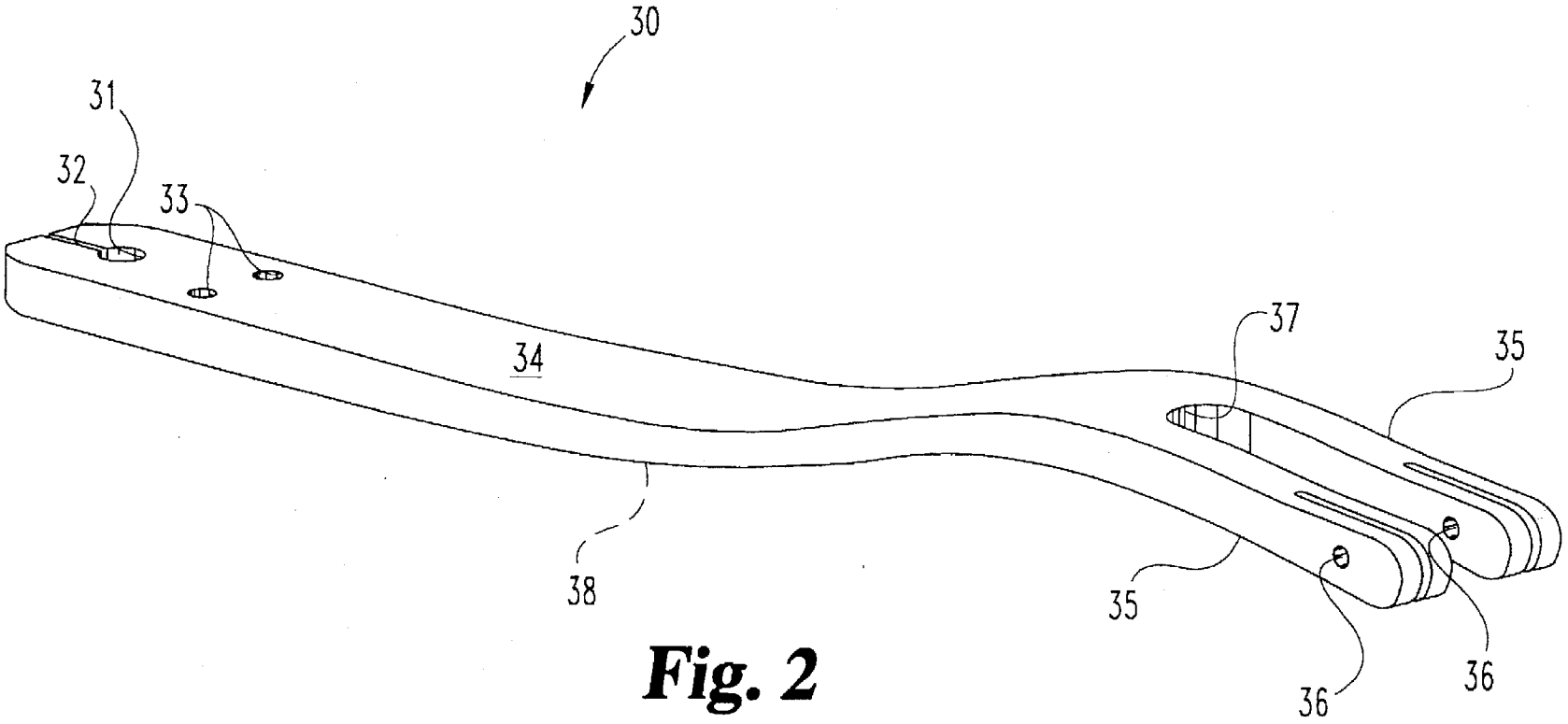
FIG. 2 is a perspective view of a composite bow limb made in accordance with one embodiment of the present invention.

Referring now to FIG. 2, there is shown an optimized bow limb 30 made in accordance with the present invention. Bow limb 30 includes keyhole 31 and key slot 32, by which the bow limb 30 is secured to the handle (23 of FIG.1) of the compound bow using key screws (24 of FIG. 1). Pivot holes 33 appear roughly two inches up from the key hole 31 along the body of bow limb 30, on the belly portion 34 of the bow limb 30. It is the belly portion 34 of the bow limb that is directed towards the string (21 of FIG. 1) when the compound archery bow 20 is assembled. The opposing surface of the bow limb is the face portion 38. Additionally, the tines 35 of the fork section, which are separated by the full radius slot 37, include the axle holes 36.

It has been found that in order to optimize the bow limb 30, it is important to optimize the beam integrity and cyclical life of the bow limb. Thus, the bow limb 30 of the present invention utilizes thin fabric weaves or fabric plies (50 of FIG. 3A) which are impregnated with a homogeneous resin system. This material has been chosen as the optimal material for constructing the present bow limb because (1) it allows for finely controlled placement and orientation of the material to manage the stress induced by bending; (2) homogeneous resin eliminates the stress planes or fault lines associated with glue lines; (3) the fabric plies are abrasion resistant helping to prevent surface cracking due to fatigue; and (4) the matrix epoxy resin is modified with elastomer or thermoplastic additives which significantly increase the toughness of the resin, yielding a laminate with a much higher impact resistance. In addition the modified epoxy resin substantially increases the limb's ability to resist fatigue induced microcracking. The lifetime of the limb is further increased by managing the stress induced by bending of the limb during deflection. It has been found that the higher the stress level across the beam, the lower the cycle life of the beam. Prior art bow limbs typically have some area of the limb wherein a peak stress level is applied. For example, in a constant thickness limb it is possible for the stress buildup at some portion along the limb to peak at 120 ksi. In an optimized beam in accordance with the present invention, the stress may be evenly distributed throughout the working area of the limb at about 80 ksi (FIG. 8).

Figure 4A:
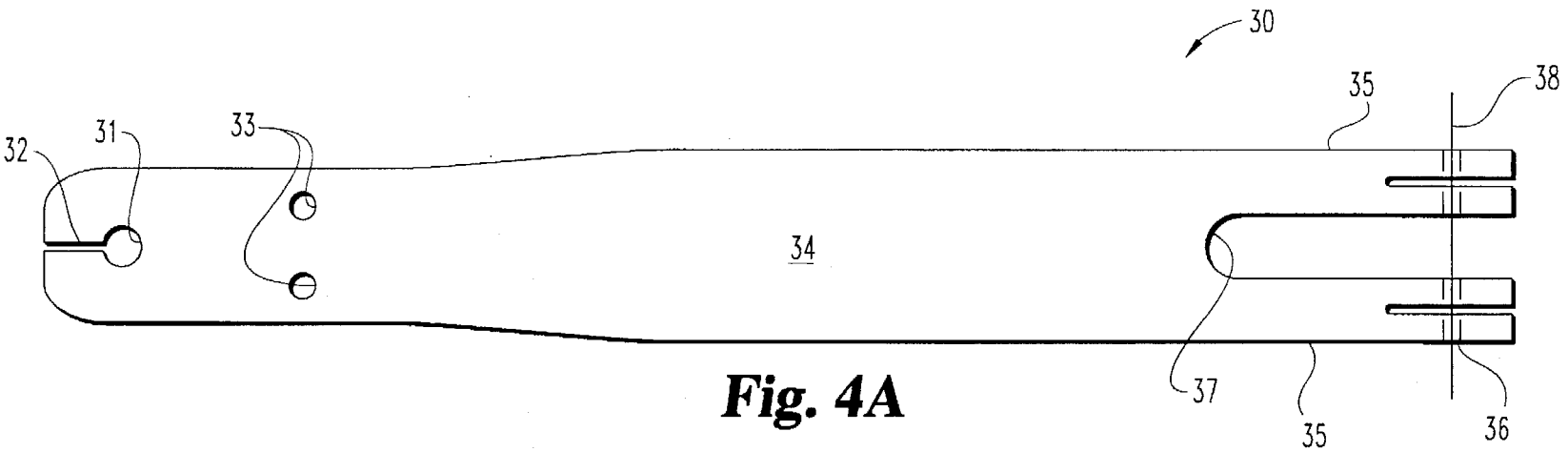
FIG. 4A is a top plan view of a completed composite bow limb in accordance with the present invention.
Figure 4B:
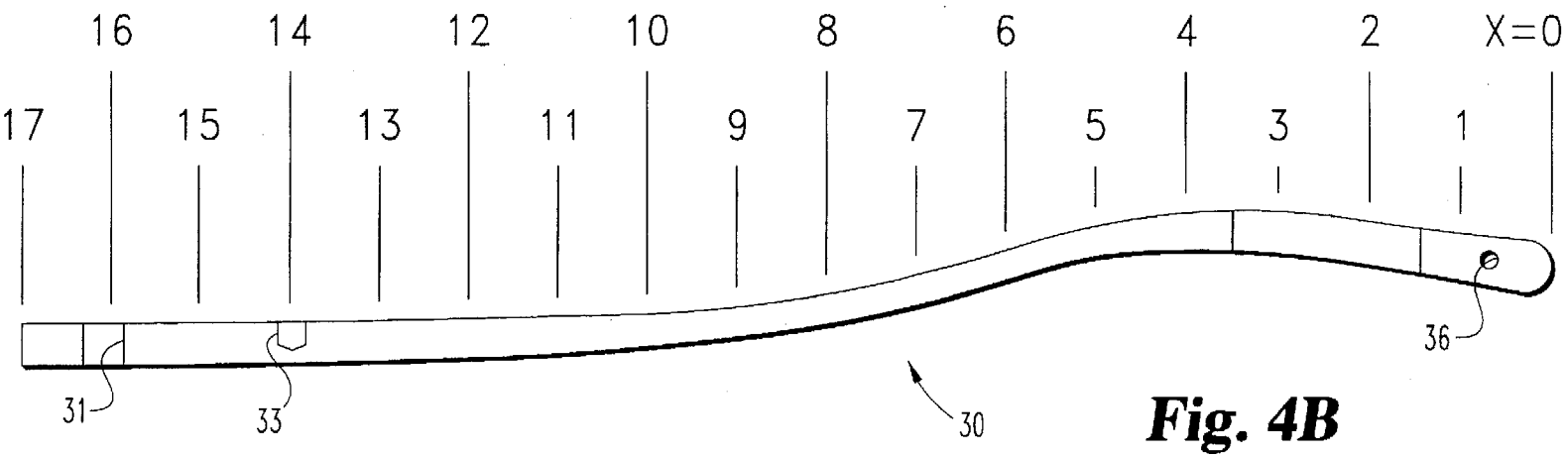
FIG. 4B is a side plan cross-sectional view of the bow limb of FIG. 4A.
Figure 8:
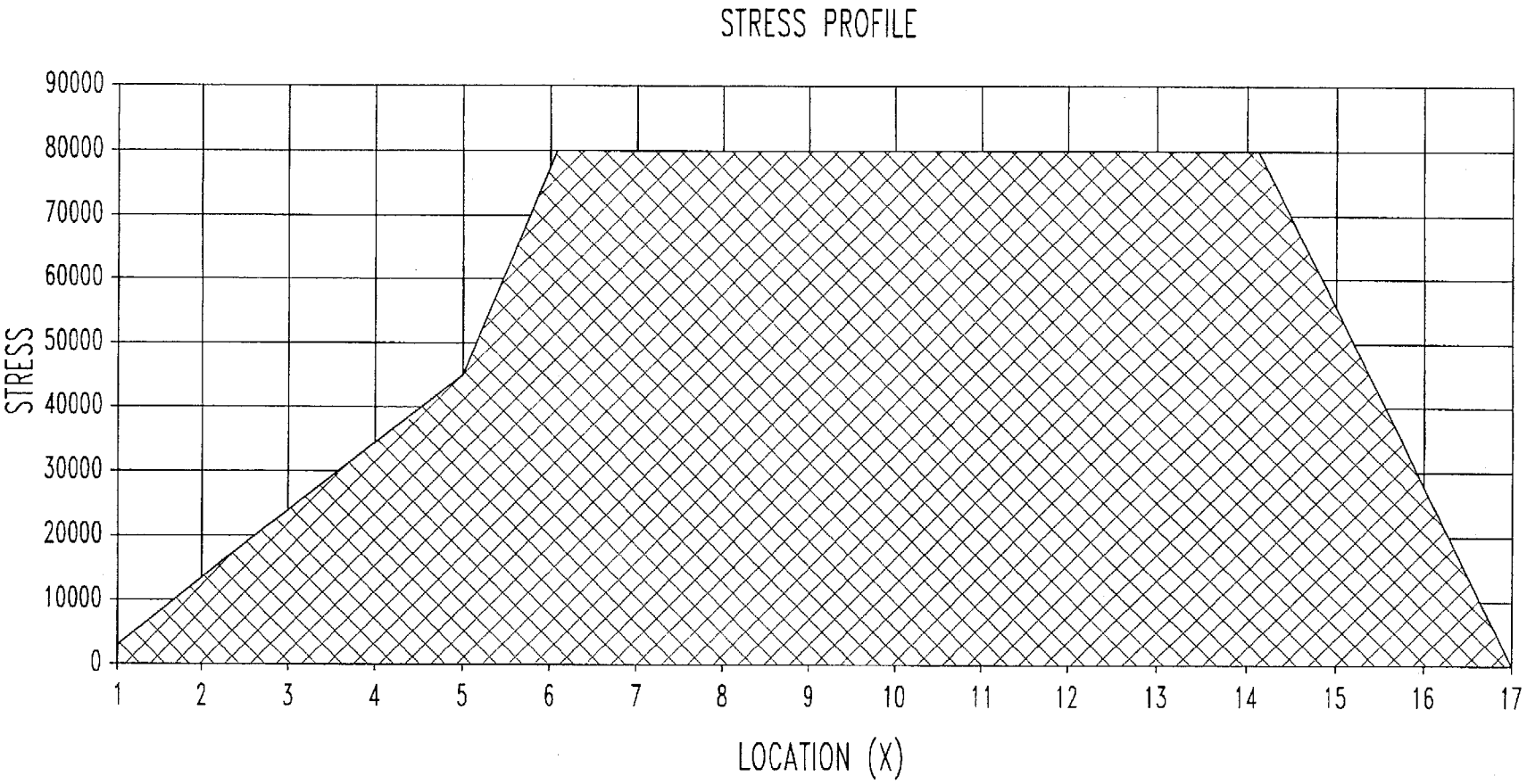
FIG. 8 is a graph showing the ideal stress profile for an optimized bow limb made in accordance with the method of the present invention.

Referring now to FIGS. 4B and 8, in FIG. 8 there is graphically shown an ideal optimized stress curve for a composite limb in accordance with the present invention. The position (x) along the location line of the graph in FIG. 8 corresponds to the position x shown along the limb 30 in FIG. 4B. Position x represents the position along the limb related as the distance from the tip of the limb. The "working area" of a limb is that area distant from the tip (position 0 of FIG. 4B) of the limb which bears the greatest amount of stress due to deflection of the bow limb. Thus, for example, on the limb 30 of FIG. 4B, the working area extends from about x=6 to x=16. One goal of the present invention is to provide a limb that bears stress evenly throughout the working portion of the limb and to extend the working portion of the limb, thus lowering the overall stress level, so that no single segment of the limb is over worked. This will increase the lifetime of the limb.

It has been found that the stress (δ) along the bow limb 30 is related to the bending moment (M) of the limb, which is the result of the applied load at the axle hole of the limb. Stress (δ) is additionally related to the moment of inertia (I) of the limb. As such, it has been found that:

$$M = Wx_a \tag{1}$$

wherein, W is the force at the axle hole of the bow limb and $x_a$ is the perpendicular distance from the force vector W to the pivot hole locations (33 of FIG. 2). For limbs that use a secondary axle mount system to support the axle instead of drilled axle holes, $x_a$ is the relative location from the axle along the limb, as supported by the secondary axle mount system. For purposes of the present disclosure, wherever the term axle hole is used as a reference point, it is to be understood that the axle location of a secondary axle mount system should be substituted, as described above.

Additionally, the stress for a rectangular beam may be determined from:

$$\sigma = \frac{Mc}{I} \tag{2}$$

wherein c is half the height (thickness) of the beam and I is found from:

$$I = \frac{bh^3}{12} \tag{3}$$

wherein b is the width of the limb, (the base of the rectangle) and h is the height of the limb (the height of the rectangle).

Thus:

$$\sigma = \frac{12Wx_a h}{2bh^3} \quad (4)$$

or $$\sigma = \frac{6Wx_a}{bh^2} \quad (5)$$

From this relationship it can be seen that the height of the limb can be given as follows:

$$h(x_a) = \sqrt{\frac{6Wx_a}{b\sigma}} \quad (6)$$

From this it can be seen that the height $h(x_a)$ of the limb is proportional to the square root of the distance from the axle hole 36 located near the tip of the limb or:

$$h(x_a) = C\sqrt{x_a} \text{ or } h(x_a) \propto \sqrt{x_a} \quad (7)$$

In the present invention, the tip region (from about position 0 to position 5 of the limb 30 of FIG. 4B) for reasons discussed herebelow is generally thicker than the adjacent region or working area, and the thickness is nearly constant. Based on relationship (7) above, it can be seen that in optimizing the stress along the limb, the thickness of the limb should increase as a function of the square root of the distance from the axle hole 36 of the limb. However, as noted above, this rule ignores the stress concentration in the fork region. Thus the limb of the present invention is optimized by providing adequate stiffness in the tines 35 of the fork region by making those tines 35 relatively thick and of nearly constant thickness, and by distributing the stress equally over substantially the remainder of the limb body by increasing the thickness over the entire remainder of the body of the limb by an amount proportional to the square root of the distance ($x_a$). For nonrectangular bow limbs, the width of the limb would additionally be related to the thickness or $h(x_a)$ of the limb.

Figure 3A:
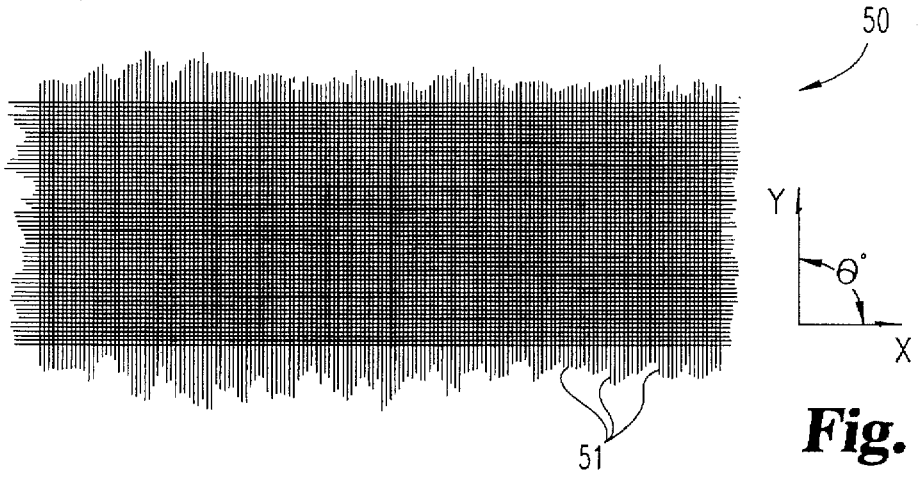
FIG. 3A is a top view of a woven fabric ply used in making at least one embodiment of the composite bow limb of FIG. 2.

Referring now to FIGS. 3A–3F, there is shown a method of making a bow limb, such as limb 30 of FIG. 2, in accordance with the present invention. In FIG. 3A there is shown a fabric ply of one type used in the present invention. The fabric ply of FIG. 3A is a woven fabric ply 50 having interwoven glass fibers 51. Weave 50 has woven glass along an X axis, as well as along a Y axis. The X and Y axes are separated by an angle θ which in the presently shown case is equal to 90°. As will be discussed in connection with FIGS. 9B–9D, θ can be other angles, such as for example, 30° or 45°, or any other desired angle between 0° and 90°. The fabric weaves 50 having interwoven glass fibers, may of a be known type of glass fabric weave.

The above description is not meant to be limiting. Alternatively, it is possible to use other types of fabric plies, one example of which would be fabric plies wherein fibers of a first orientation are laid over fibers of a second off-axis orientation, and together, the fibers encased together in a resin system to form the thin fabric plies described herein. However, in the present invention, the use of woven fabric plies is preferred.

In the preferred embodiment, an E-glass fabric with a predominant number of ends in the warp direction relative to the fill is used. This warp to fill ratio should range from 60% warp x 40% fill to 90% warp x 10% fill. In the preferred embodiment, the ratio of warp ends to fill ends is about 80% warp x 20% fill. The same fabric weave to warp fill ratio ranges may be used on S-glass plies applied to the tension side of the limb, with the preferred range again being about 80% warp x 20% fill. The S-glass and graphite fabrics are used to increase the strength of the fibers on the tension side of the limb where the highest stresses occur. One example of such an E-glass fabric weave is the 7707/7576 fabric weave made by FIBERITE®. Additionally, an S-glass fabric, such as the 7707/6576 by FIBERITE® or a graphite weave material may be used in combination with or instead of the E-glass fabric. The above examples are not meant to be limiting as types of fabric weaves other than E-glass and/or S-glass may be used. Further, fabric weaves of different types made by companies other than FIBERITE® may be used.

The fabric weave 50 is impregnated with a resin. It is contemplated that in practicing the present invention thin pre-impregnated fabric weaves (or pre-preg sheets) are used.

In managing the stress and stiffness throughout the limb, thus fulfilling relationship (7) above, it is necessary to build up certain portions of the limb without also building up other portions of the limb. To achieve this smaller weaves are chosen so as to locate the material and the associated stress exactly where it is needed. In some embodiments of the present invention, pre-impregnated fabric weaves of a thickness between 0.005–0.025 inches may be used. However it is preferred that pre-impregnated fabric weaves of between 0.007–0.015 inches be used, with the most preferable thickness being chosen from among the range of 0.007–0.012 inches. When using plies of between 0.007–0.012 inches, it is possible, for example, to have 50 plies in a first area of the limb, such as the tip and/or tang ends, and have only 25 plies in another area of the limb. Choosing plies of between 0.007–0.012 inches thickness additionally allows for the fine tuning of the limb thickness to obtain bows of different draw weights while maintaining the fiber/resin ratio (i.e. performance life relative to fiber/resin ratio). The distribution of thin weave plies allows for better control of both stiffness and stress along the limb, as well as accurately controlling the above-noted fiber/resin ratio.

Figure 3B:
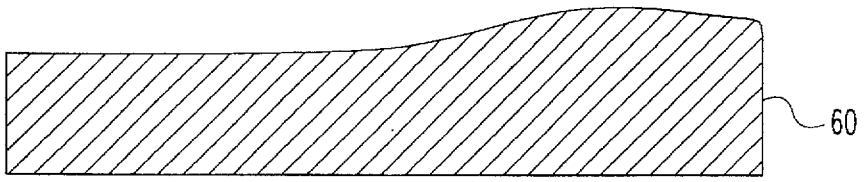
FIG. 3B is a side cross-sectional view of the base portion of a contoured mold useful in making composite bow limbs in accordance with the present invention.
Figure 3C:
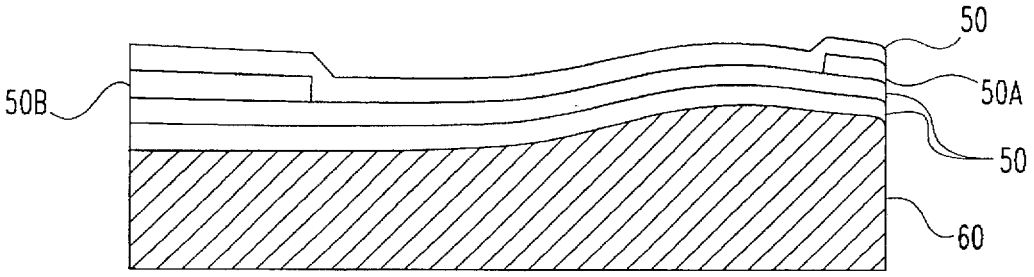
FIG. 3C is a side cross-sectional view of mold of FIG. 3B having layered woven plies thereupon.
Figure 3D:
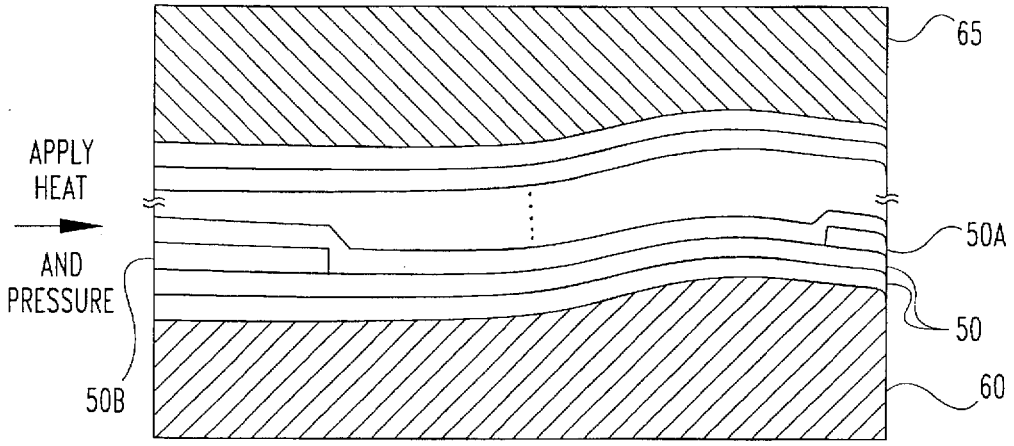
FIG. 3D is a side cross-sectional view of a complete mold of the type useful for making the composite bow limb of the present invention and having layered plies therein.
Figure 3E:
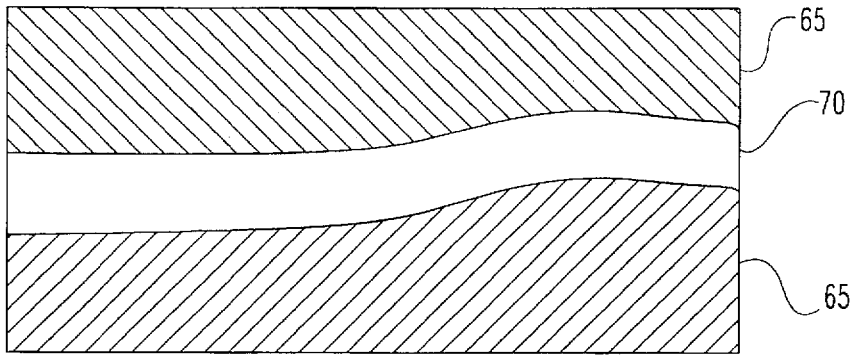
FIG. 3E is a side cross-sectional view of the mold of FIG. 3D including a composite bow limb blank of the present invention after heat and pressure have been applied.
Figure 3F:
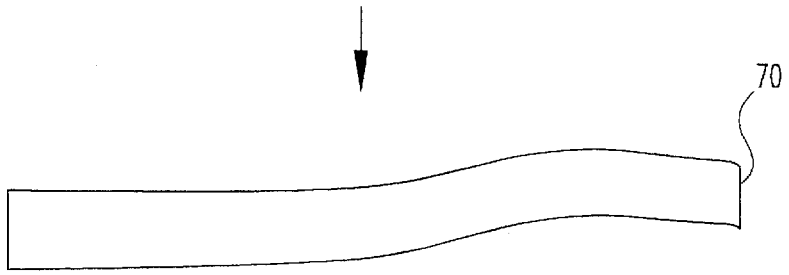
FIG. 3F is a side view of the composite bow limb blank of FIG. 3E.

In FIGS. 3B–3D there is shown a contoured base portion 60 of a mold upon which the resin impregnated weave 50 is deposited. Mold shapes other than contoured molds (i.e. flat molds, molds of other shapes, etc.) may be substituted for the mold shown in FIGS. 3B–3D. As shown more particularly in FIG. 3C, pre-preg sheets 50 (not shown to scale) are layed up on the base portion 60. Additionally, in order to selectively build up the limb in accordance with relationship (7) in the working area of the limb, as well as to provide added stiffness in the tip portion, partial plies such as 50A and 50B are used. As such, material is placed exactly where it is needed and not where it is not, and thus, the thickness of the resulting limb may be selectively adjusted.

Once the completed bundle of all desired pre-impreganted fabric weaves 50, 50A and 50B have been layed up on the base 60, a contoured mold top 65 is fitted as shown in FIG. 3D. Heat and pressure are applied so as to make the pre-impregnated resin matrix of the weaves 50, 50A and 50B flow freely, thus forming a homogeneous resin system without stress planes or fault lines associated with glue lines. In order to apply sufficient heat and pressure, either an autoclave or a compression molding system may be used. In the preferred embodiment, the layed up weaves in the mold are put under 100 +/−10 psi of pressure at about 275° +/−10° F. for about 60 minutes. Curing at a high temperature and pressure ensures that the resin flows evenly throughout the fabric weaves and ensures that the resulting paddle 70 (FIGS. 3E and 3F) is homogeneous. Additionally, curing the materials only once, in a single cure cycle, improves the strength of the limb as well as reduces the costs of production. Molding as described herein eliminates the internal stress caused by the bonding and curing of dissimilar materials in a single cycle which had been experienced in the prior art. The resulting paddle 70 may be sized so as to produce a single limb, or may be of a size suitable for sawing up as multiple limbs.

Figure 9A:
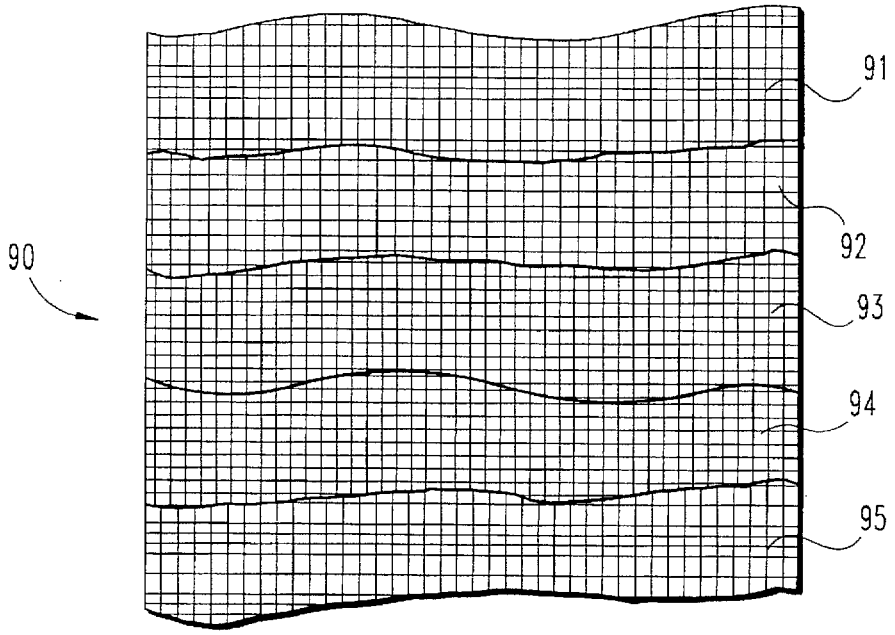
FIGS. 9A–9D are top plan views of some of the preferred embodiments of composite structures with various laminations cut away shown prior to the application of heat and pressure as shown in FIG. 3D.

Referring to FIGS. 9A–9D, in FIG. 9A there is shown a composite structure with various laminations cut away of one preferred embodiment of the present invention. The structure 90 corresponds to a portion of the bundle of layed up weaves shown in the mold of FIG. 3D, prior to being acted upon by the applied heat and temperature. As can be seen, in a first preferred embodiment, all of the weaves used to make the limb are of the "90° orientated" weave material. This 90° oriented weave material includes both fibers placed in parallel with the longitudinal axis of the limb (which passes longitudinally through the length of the limb) interwoven with off-axial glass running perpendicular to the longitudinal axis. The off-axial glass aids in distributing the stress along the limb.

Figure 9B:
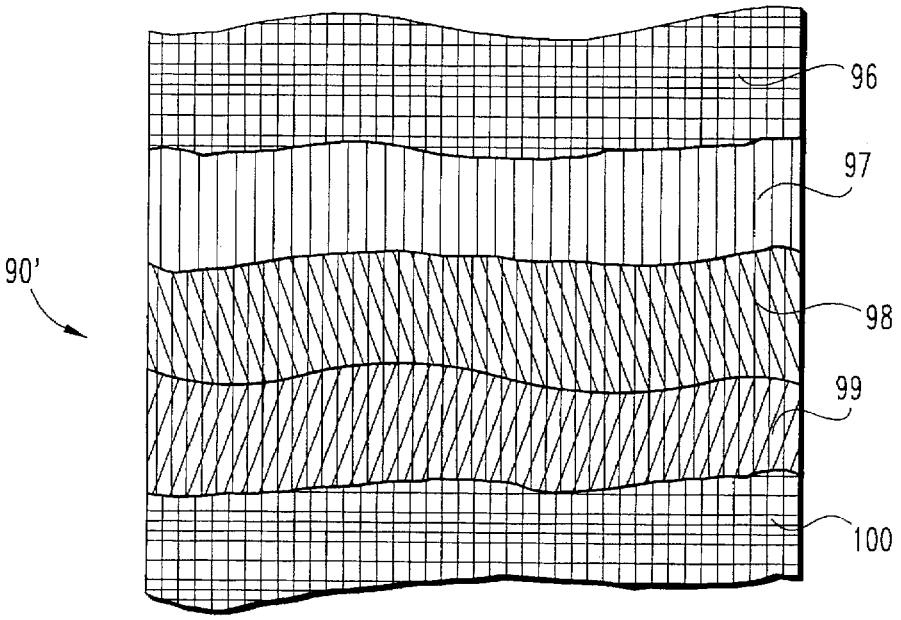
Figure 9C:
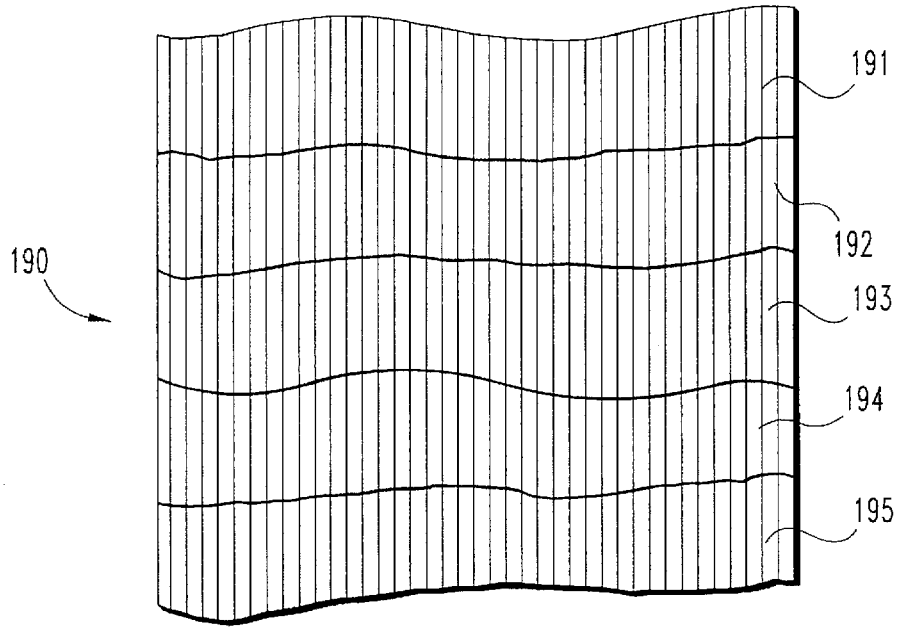
Figure 9D:
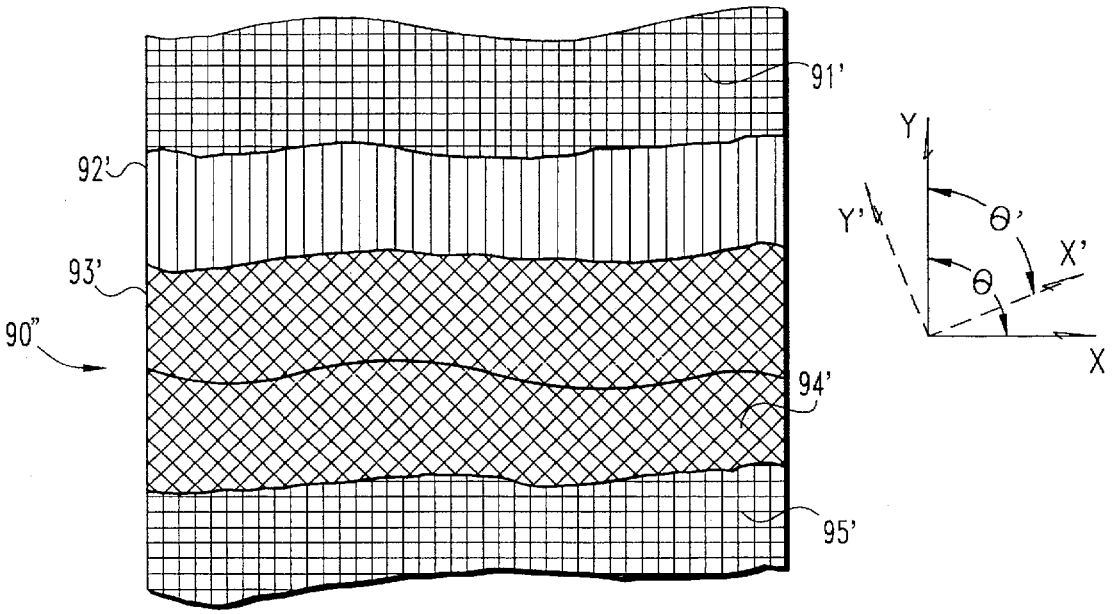

Further, in FIGS. 9B and 9D there are shown other embodiments of the present invention, wherein in the structure 90' or 90" there are various 90° laminates (i.e. 96, 91', 95' and 100). Further in FIGS. 9B and 9D there are various woven resin impregnated laminates wherein the various fibers are oriented at angles different from those of sheets 96, 91', 95' and 100. In FIG. 9B the woven laminates of sheets 98 and 99 comprise longitudinally oriented glass interwoven with off-axial glass having an angular variation of less than 90° from an axis running through the length of the longitudinally oriented glass. For example, the sheets 98 and 99 of FIG. 9B are shown having a 30° and 45° differences, respectively. This is not meant to be limiting as the angular variation may be chosen to be from 1° to 90° (inclusive). As such, the internal angle of the weave of the laminates may be changed.

In FIG. 9D there is shown a variation in which the resin impregnated woven laminates 93' and 94' still maintain an internal weave angle of about 90°, but wherein the laminate sheets have been turned θ'° with respect to the longitudinal axis through the length of the limb. The amount that the laminate is turned θ' may be chosen to be from 1° to 90°, inclusive.

Optionally to minimize production costs, layers of unidirectional glass (i.e. 92', 97) may be used in the embodiments of FIGS. 9A, 9B and 9D. However, preferrably, it is desired that at least 30% of the laminates used to make the limb be of woven fabric plies. More preferrably, more than 50% to 100% of the laminates used to make the limb be of woven fabric plies having off-axial glass of some angular orientation interwoven with the longitudinally oriented glass. Most preferably, the limb would be assembled entirely of woven fabric plies.

In FIG. 9C there is shown a composite structure with various laminations cut away of a further embodiment of the present invention. In the present embodiment, the paddle may be laid up according to the method of FIGS. 3B–3E described herein using both full and partial laminates or plies consisting of longitudinally oriented unidirectional glass. The unidirectional glass laminates may be laid up such that a first portion of the working area of the limb was made using more laminates than a second portion of the working area of the limb. As described herein, laying the laminates up as in FIG. 9C results in a finished composite limb having a first portion of the working area being thicker than a second portion of the working area, but wherein all fibers are longitudinally oriented.

Additionally, it is possible to use full and partial laminates made up solely of unidirectional glass wherein the longitudinal axis of the fibers is off-axis with the longitudinal axis of the limb. One example, of this would be if in the embodiments of FIGS. 9B or 9C plies 97 or 194, respectively, were turned some angle between 1° and 179° with respect to the longitudinal axis through the length of the limb. In all figures, the longitudinal axis through the length of the limb is the axis "Y" as shown in FIG. 9D.

Referring now to FIGS. 4A–7, there will be given one particular example of a composite bow limb constructed in accordance with the present invention. The use of this example is not meant to be limiting as the manufacture of the limb would vary depending on the various characteristics and properties of bow limb (stiffness, deflection, weight, etc.) desired. Referring now to FIG. 4B, there is shown a side plan cross-sectional view of a bow limb 30, such as the limb 30 shown in FIGS. 2 and 4A. The tip of the fork section is located at point x=0. The limb extends from the tip of the fork section to the tang or end portion of the limb located at position 17. The partial views of FIGS. **5*a*–5*d* depict a table when arranged in accordance with the diagram of FIG. 5. As used herein, FIG. 5 refers to this table and FIGS. 5*a*–5*d*** so arranged.

Figure 5:
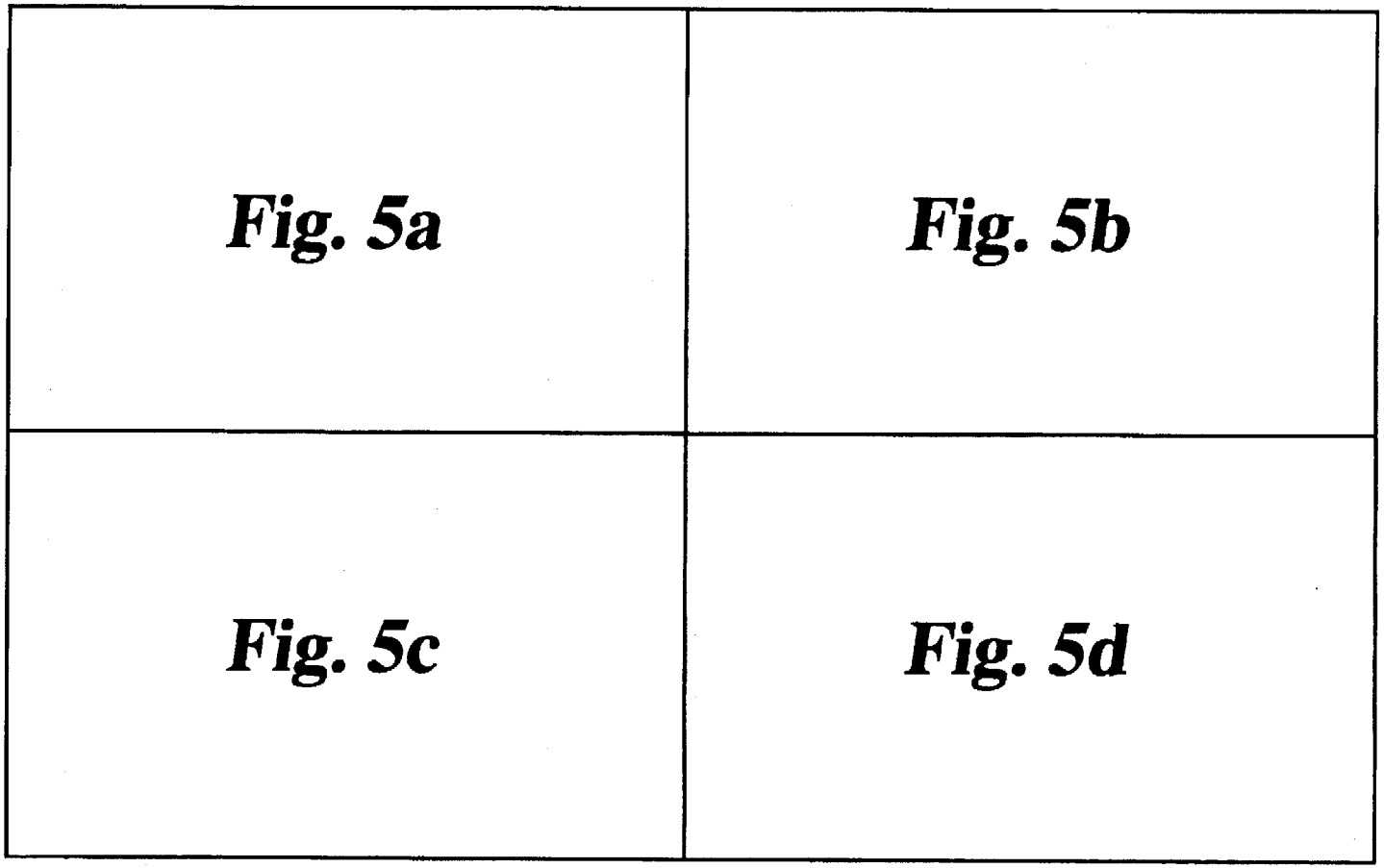
FIG. 5 is a diagram depicting an arrangement of the partial views of FIGS. *5a–5d* which collectively show a table of the placement of plies in forming one specific example of a composite bow limb in accordance with the present invention.
Figure 5A:
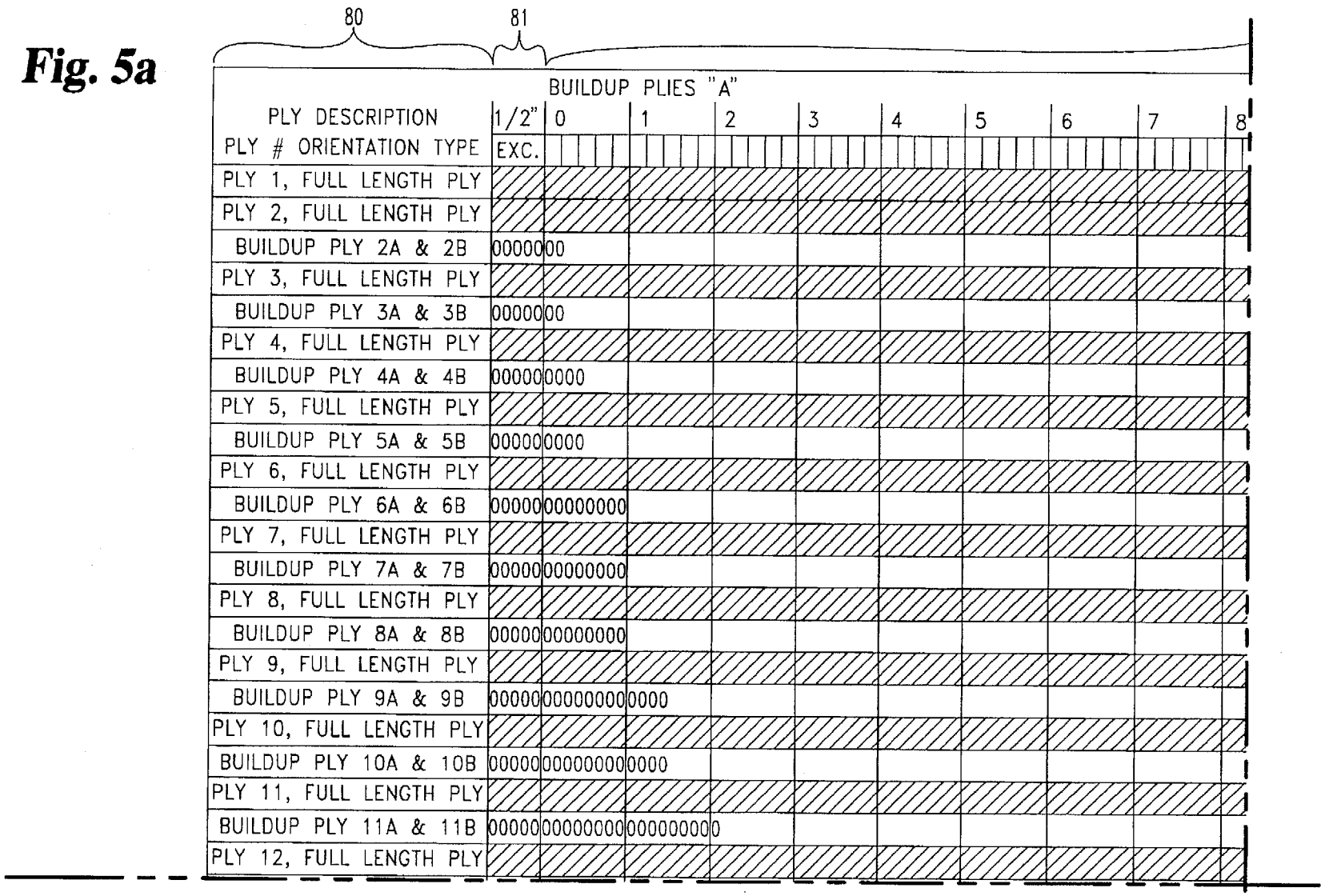
Figure 5B:
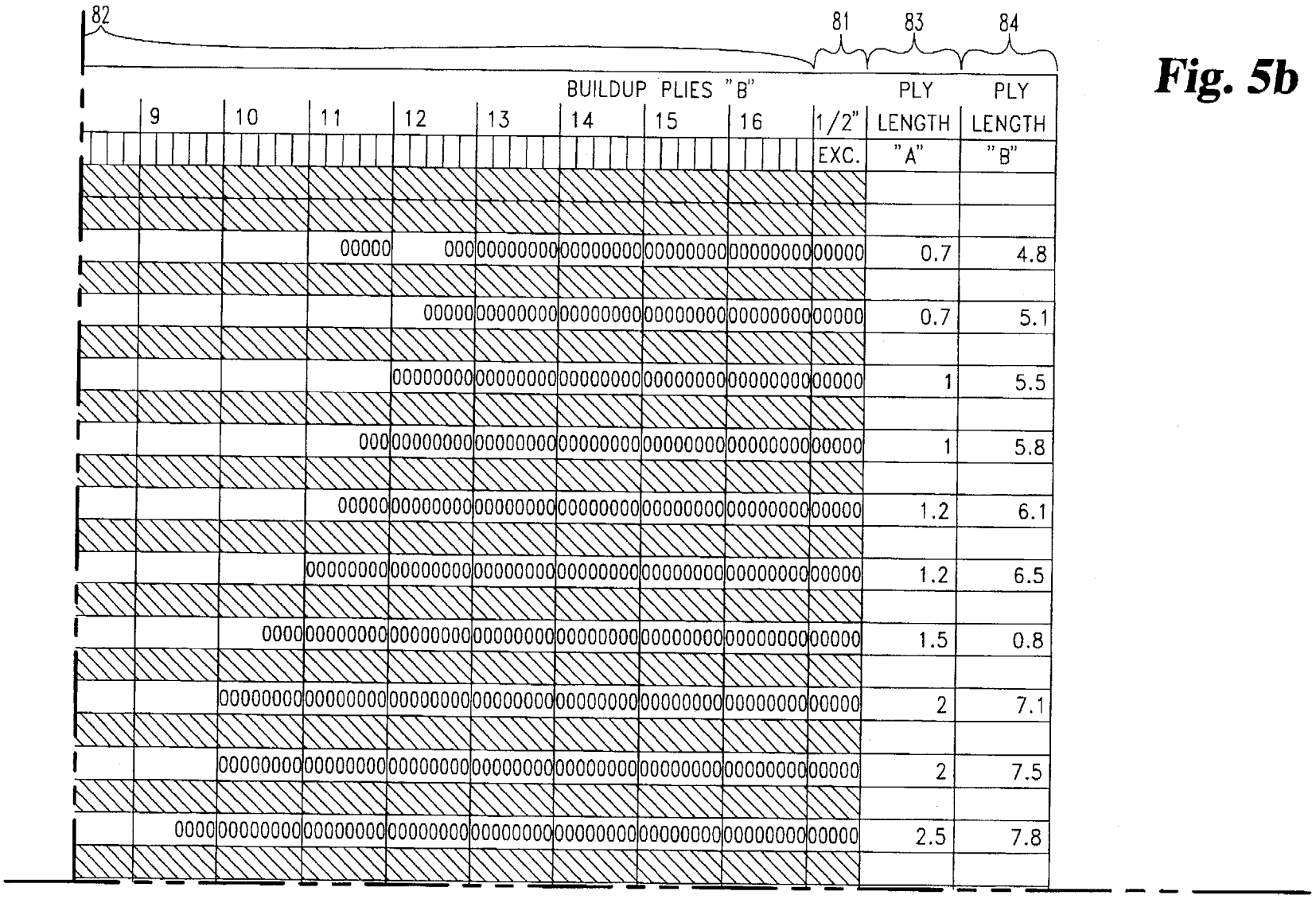
Figure 5C:
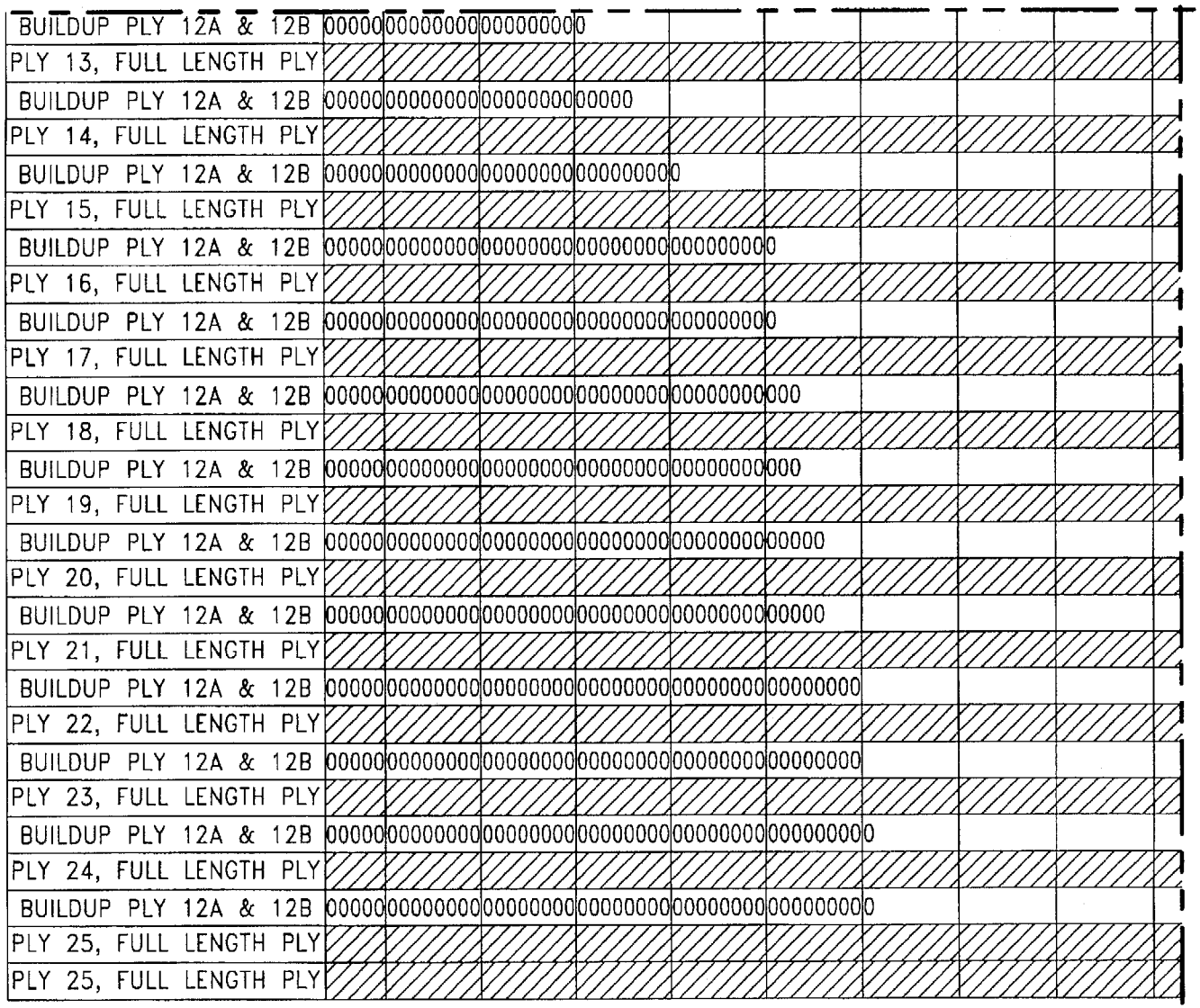
Figure 5D:
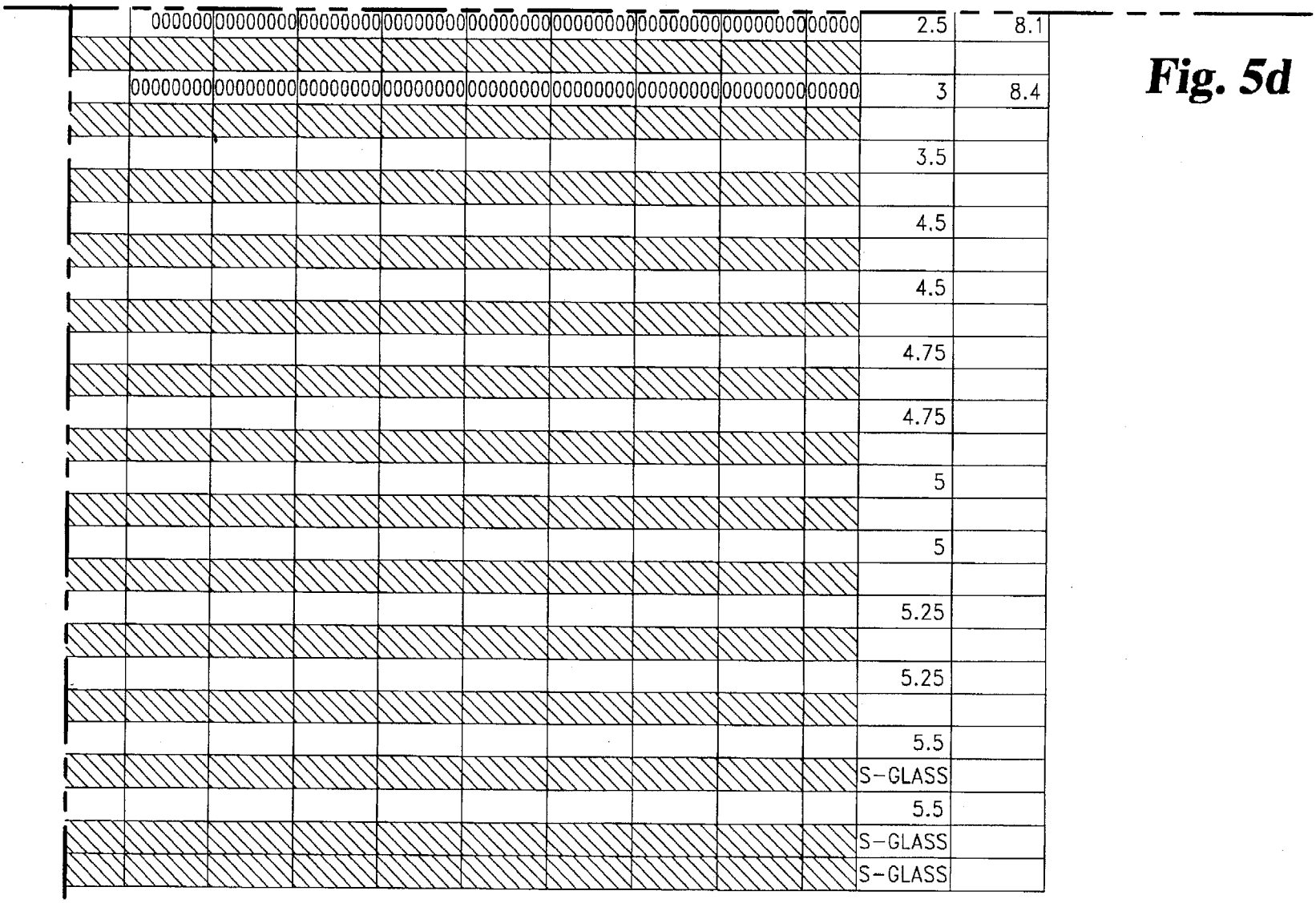

In FIG. 5 there is shown a lamination table showing the different layers used to make one particular bow limb made in accordance with the present invention. Additionally, the optimized height limb table of FIG. 6 gives the data for the bow constructed in accordance with the lamination table of FIG. 5. Column 80 of FIG. 5 is a description of the plies used to build the particular limb of the present example. As detailed in column 80, both full plies and partial or buildup plies are used. Buildup plies are as shown as 50A and 50B of FIG. 3C.

Columns 81 of FIG. 5 show that, in the present example, ½ inch of excess ply is used at either end of the mold. The ply portion of the table 82 shows where plies are applied in the mold. For example, the first two layers of the present bundle in our example are full plies, which is demonstrated by the shaded line extending all the way across the column 82 in the first two rows of that column. The third layer of the present bundle comprises a buildup ply "A" extending for 0.7 inches from the end of the fork end, and a buildup ply "B" extending 4.8 inches from the end of the limb portion distal from the end of the fork end. The above measurements taken from the respective ends of the limb include the 0.5 inches of excess described above. The lengths of the buildup plies are given in columns 83 and 84 of the lamination table of FIG. 5. It can be seen from the lamination table that, excluding the tip region from x=0 to about x=5, the thickness increases as a function of the distance away from the axle hole (about x=0.625). This correspondence can also be seen in the optimized height table of FIG. 6 in the row entitled FINAL HT.

Figure 7:
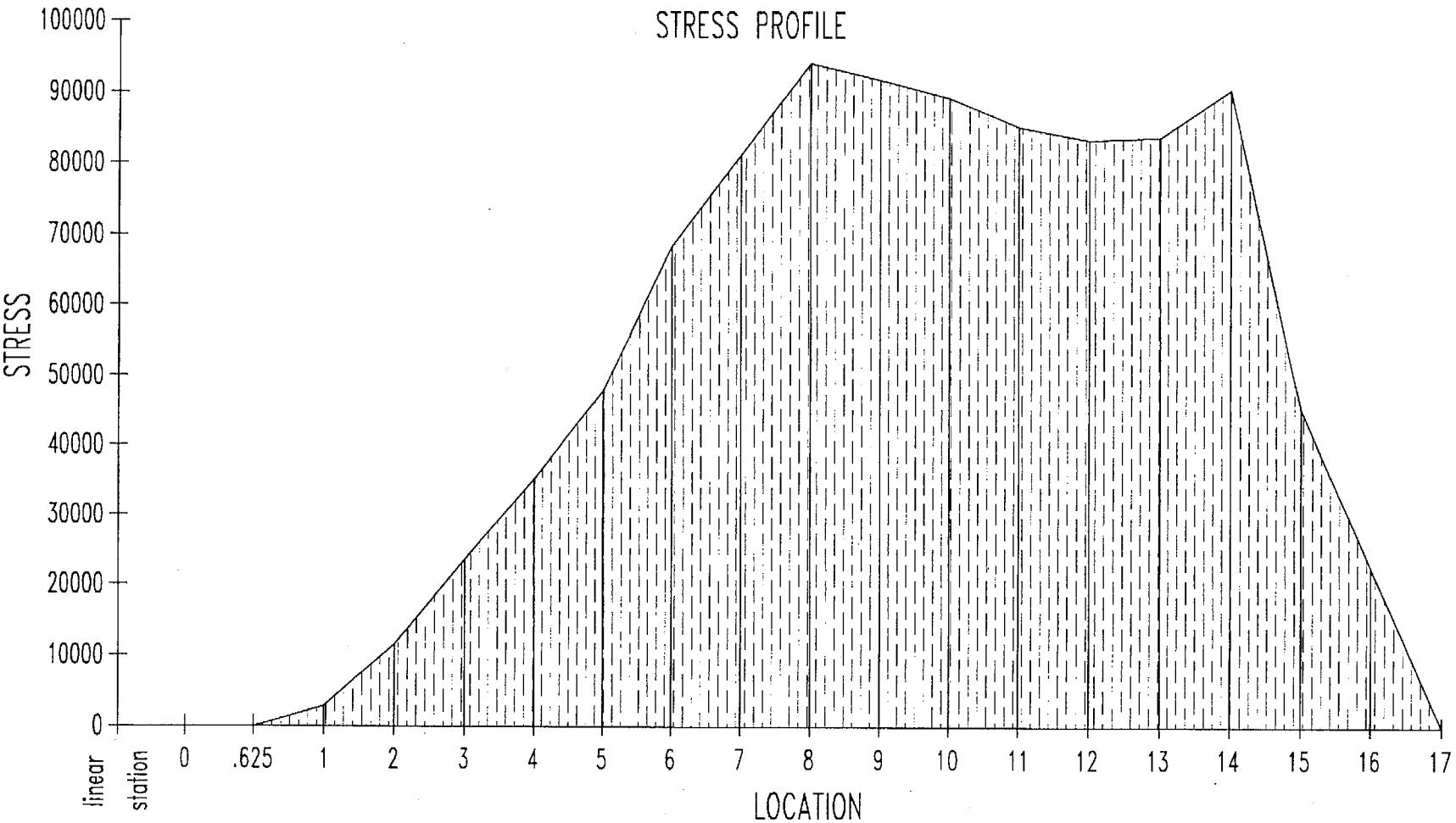
FIG. 7 is a graph showing the actual stress profile of the composite bow limb made in accordance with the data in the tables of FIGS. 5 and 6.

Further, it can be seen from FIG. 6, in the row entitled "stress", that the stress on the working area of the limb from positions x=7 to x=14, the stress is about equal. The graph of FIG. 7 is a plot of the stress of the limb of the present example versus location along the limb, charted from the data given in the optimized height chart of FIG. 6 for the beam of FIGS. 5 and 6, with the excess removed.

An example of one limb manufactured in accordance with the present embodiment was constructed as follows. First, all of the plies were cut to be 25" wide. Full plies were cut to be between 17' and 18' long. Buildup plies are 25" wide and the lengths shown in columns 83 and 84 of the lamination table of FIG. 5. All of the full and buildup plies for the limb of the present example comprised a woven fabric and epoxy resin system, such as 7707/7575 E-Glass fabric made by FIBERITE. Again, other types of woven fabric and epoxy resin systems may be used. The ply lamination table of FIG. 5 reports the orientation.

Next, the plies were kitted in the order indicated in the lamination table of FIG. 5. Three to four box coats of a suitable mold release agent, such as frekote 44 mold release, were applied. The solvent was allowed to flash off between application.

Next, the parts were layed-up in the order indicated in the ply lamination table. The plies were manually compacted as they were layed-up. If an autoclave is used to make the paddle, a vacuum bag is used. Additionally, in an autoclave procedure, excess resin may be bled off to finely tune the thickness of the resulting limbs. However, the resin bleed technique is unnecessary if a compression molding process is used, as the mold is pressed to stops controlling the final limb thickness. A typical cure cycle for the autoclave and compression molded limbs is as follows: Temperature may be ramped up to 275° +/−10° F. at a rate of 3–5 DEG/MIN. Then hold at 275° +/−10° F. for 30–60 minutes. Begin the hold when the lagging part of an associated thermocouple reaches 265° F. The part is cooled to below 150° F. at a maximum rate of 7° F./MIN.

After the paddle is formed, it is removed from the mold, wherein it is sawn into separate limb sized pieces. The excess is remove and the full radius slot, fork slots, axle holes, pivot holes, key hole and key slot are machined and/or drilled in.

In the present example, in the lamination table of FIG. 5 it is stated that the last three full plies on the face of the limb are S-glass weaves, as distinguished from the E-glass weave used throughout. Additionally, graphite weaves may be substituted for the S-glass. Likewise, other weaves may be substituted for the E-glass.

Referring back to FIGS. 2, 4A and 4B, it is additionally possible to further optimize the performance of the composite bow limb of the present invention. One problem encountered with composite bow limbs of the prior art is that the axle hole 36 is prone to failure when the bow 20 is dry-fired. Typically, the axle will split the laminate along a resin plane. By building up the fork tines with additional plies, as is done in the bow limb example constructed according to the lamination table of the example of FIG. 5, as well as is shown in FIG. 4B, the stiffness of the tines is increased. These high stiffness tines resist the off-axial torques induced in the limb through pulley and string forces. The axle holes 36 are aligned concentrically around an axis 38 (FIG. 4A). When off-axis torque loads due to dry-firing are induced in the limb through off center pulley and string forces, the axle acts as a lever arm splitting the laminas. By reinforcing the stiffness in the fork tines using buildup plies, as noted herein, the axle holes are forced to stay in plane. Thus the axle cannot pry apart the laminates. Thus the use of thin fabric plies to selectively build up the tines of the fork section increases the life of the limb by protecting against dry-fire failure modes.

Additionally, the use of fabric weaves throughout the limb and stress management in the working area of the limb additionally optimizes the bow limb 30 by reducing edge peel and fork cracks. Edge peel and fork cracks are problems associated with material orientation, bond line integrity and high stress concentrations. The use of fabric weaves in accordance with the present invention places off axial glass in regions susceptible to edge peel and cracks, thus preventing surface cracks from developing. Further, the homogeneous resin system and single thermal cycle cure eliminates resin rich areas and bondlines. Additionally, the management of stress through selective control of the thickness of the limb and the use of fabric weaves reduces stress concentrations that could damage the limb.

Further, as shown particularly in FIGS. 2 and 4A, one embodiment of the limb of the present invention uses a full radius fork, rather than a "V" shaped fork, to reduce stress buildup and provide a uniform stress field around the fork area. However, other shapes of forks may be used.

Additionally, pivot hole cracking and buckling may be reduced in the limb of the present invention in two ways. First, the use of fabric plies with controlled amounts of 90° orientation material prevents cracks from running out of the pivot holes 36. Second, in the present invention stress concentrations caused by locating holes have been minimized by reducing the diameter and depth of the pivot holes 36. By reducing the diameter and hole depth, the material available to bear compressive loads from bending is likewise increased, thus smaller holes increase the limbs ability to bear compressive loads. The pivot holes of one preferred embodiment of the present invention have been chosen to be 3/16" in diameter and from about 0.125–0.060 inches deep, the shallower depth being preferred. Alternatively, other pivoting methods may be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A composite bow limb, comprising:

a working area portion having a proximal end and a distal end;

a fork section having a proximal end and a distal end, said proximal end of said fork section being located adjacent said distal end of said working area portion, said fork section including two tines, the distal end of said tines being the distal end of said fork section and of the composite bow limb;

wherein the composite bow limb is composed of multiple fiber layers, said multiple fiber layers being encased entirely in a single homogeneous resin; and wherein the thickness of said working area portion decreases from said proximal end of said working area portion to said distal end of said working area portion.

2. The composite bow limb of claim 1, wherein said fiber layers of the composite bow limb include fiber layers consisting essentially of longitudinal fibers.

3. The composite bow limb of claim 1, wherein said fiber layers of the composite bow limb include fiber layers comprising fabric sheets of fibers, said fabric sheets including longitudinal fibers located along a longitudinal axis through the length of said composite bow limb and off-axial fibers oriented at a non-zero angle from said longitudinal fibers.

4. The composite bow limb of claim 3, wherein said fabric sheets include woven sheets wherein said angle between said longitudinal fibers and said off-axial fibers is 90°.

5. The composite bow limb of claim 4, wherein said woven sheets additionally include woven sheets wherein said angle between said longitudinal fibers and said off-axial fibers is between 0° and 90°, non-inclusive.

6. The composite bow limb of claim 3, wherein said fabric sheets include woven sheets wherein said angle between said longitudinal fibers and said off-axial fibers is between 0° and 90°, non-inclusive.

7. The composite bow limb of claim 3, wherein all of said fiber layers consist of woven sheets.

8. The composite bow limb of claim 3, wherein the warp to fill ratio of said fabric sheets is about 80% warp to 20% fill.

9. The composite bow limb of claim 1, wherein said longitudinal fibers of said fabric sheets are interwoven with said off-axial fibers, so as to form woven sheets.

10. The composite bow limb of claim 9, wherein the composite bow limb includes an axle hole located near said distal end of said fork section and wherein the thickness of said working area portion at a location along said working area portion is related to the distance of said location from said axle holes.

11. The composite bow limb of claim 10, wherein said proximal end of said working area portion includes more of said fiber layers than said distal end of said working area portion.

12. The composite bow limb of claim 11, wherein said thickness of said working area portion at a location along said working area portion is proportional to the square root of the distance of said location from said axle holes when said bow limb is of constant width throughout said working area portion.

13. The composite bow limb of claim 11, wherein said more fiber layers include woven sheets.

14. The composite bow limb of claim 13, wherein at least said tines of said fork section include, more of said fiber layers than said distal end of said working area portion.

15. The composite bow limb of claim 14, wherein the thickness of said tines is substantially constant throughout said tines.

16. The composite bow limb of claim 1, wherein at least said tines of said fork section include more fiber layers than said distal end of said working area portion.

17. The composite bow limb of claim 16, wherein all of said fiber layers consist of said woven sheets.

18. The composite bow limb of claim 17 wherein said tines are separated by a fork slot, and wherein said fork slot is open at said distal end of said fork section and terminates in a face having a circular radius between said tines.

19. A composite bow limb, comprising:

a working area portion having a proximal end and a distal end;

a fork section having a proximal end and a distal end, said proximal end of said fork section being located adjacent said distal end of said working area portion, said fork section including two tines, an axle hole being drilled through said tines near said distal end of said fork section, the distal end of said tines being the distal end of said fork section and of the composite bow limb;

wherein the composite bow limb is composed of fiber layers encased in a homogeneous resin;

wherein the thickness of said working area portion decreases from said proximal end of said working area portion to said distal end of said working area portion; and wherein said thickness of said working area portion at a location along said working area portion is proportional to the square root of the distance of said location from said axle hole when said bow limb is of constant width throughout said working area portion.

20. A composite bow limb, comprising:

a working area portion having a proximal end and a distal end;

a fork section having a proximal end and a distal end, said proximal end of said fork section being located adjacent said distal end of said working area portion, said fork section including two tines, the distal end of said tines being the distal end of said fork section and of the composite bow limb;

wherein the composite bow limb is composed of fiber layers encased in a homogeneous resin, each of said fiber layers being no more than 0.025 inches in thickness; and wherein the thickness of said working area portion decreases from said proximal end of said working area portion to said distal end of said working area portion.

21. The composite bow limb of claim 20, wherein said fiber layers of the composite bow limb include fiber layers consisting essentially of longitudinal fibers.

22. The composite bow limb of claim 20, wherein said fiber layers of the composite bow limb include fiber layers comprising woven sheets of fibers, said woven sheets including longitudinal fibers located along a longitudinal axis through the length of said composite bow limb and off-axial fibers oriented at a non-zero angle from said longitudinal fibers, said longitudinal fibers being interwoven with said off-axial fibers.

23. The composite bow limb of claim 22, wherein the composite bow limb includes an axle hole located near said distal end of said fork section and wherein, the thickness of said working area portion at a location along said working area portion is related to the distance of said location from said axle holes.

24. A compound bow, comprising:

a first composite bow limb, including, a working area portion having a proximal end and a distal end;

a fork section having a proximal end and a distal end, said proximal end of said fork section being located adjacent said distal end of said working area portion, said fork section including two tines, the distal end of said tines being the distal end of said fork section and of the composite bow limb;

wherein the composite bow limb comprises multiple fiber layers encased in a homogeneous resin;

wherein the thickness of said working area portion decreases from said proximal end of said working area portion to said distal end of said working area portion;

a second composite bow limb, including, a working area portion having a proximal end and a distal end;

a fork section having a proximal end and a distal end, said proximal end of said fork section being located adjacent said distal end of said working area portion, said fork section including two tines, the distal end of said tines being the distal end of said fork section and of the composite bow limb;

wherein the composite bow limb comprises multiple fiber layers encased in a homogeneous resin; and wherein the thickness of said working area portion decreases from said proximal end of said working area portion to said distal end of said working area portion.

a handle including a first end and a second end, said proximal end of said working portion of said first composite bow limb connected to said first end of said handle by a first key screw, said proximal end of said working portion of said second composite bow limb connected to said second end of said handle by a second key screw;

a first wheel located near the distal end of said first composite bow limb;

a second wheel connected near the distal end of said second composite bow limb; and at least a string connected between said first and said second wheels.

25. The composite bow limb of claim 24, wherein said fiber layers of the composite bow limb include fiber layers consisting essentially of longitudinal fibers.

26. The composite bow limb of claim 24, wherein said fiber layers of the composite bow limb include fiber layers comprising woven sheets of fibers, said woven sheets including longitudinal fibers located along a longitudinal axis through the length of said composite bow limb and off-axial fibers oriented at a non-zero angle from said longitudinal fibers, said longitudinal fibers being interwoven with said off-axial fibers.

* * * * *